United States Patent [19]

Hendry et al.

[11] Patent Number: 4,715,284

[45] Date of Patent: Dec. 29, 1987

[54] TELESCOPED AMMUNITION CONSTRUCTION FOR REDUCING BARREL EROSION

[75] Inventors: James D. Hendry, Huntington Beach; Lee A. Tobias, Santa Ana, both of Calif.

[73] Assignee: Ford Aerospace & Communications Corp., Dearborn, Mich.

[21] Appl. No.: 934,527

[22] Filed: Nov. 24, 1986

[51] Int. Cl.[4] ..... F42B 5/02

[52] U.S. Cl. ..... 102/434; 102/435

[58] Field of Search ..... 102/430–435, 102/511, 440

[56] References Cited

U.S. PATENT DOCUMENTS 18 2/1986 Bracuti ..... 102/435

3,209,689 11/1957 McLennan .

3,426,684 2/1969 Jacobson et al. ..... 102/435

3,616,752 11/1971 Lahey et al. ..... 102/440

4,098,193 7/1978 Schroader .

4,203,364 5/1980 Dobbs .

4,334,477 6/1982 Axelrod et al. .

FOREIGN PATENT DOCUMENTS 2550208 12/1977 Fed. Rep. of Germany ..... 102/433

*Primary Examiner*—Harold J. Tudor

*Attorney, Agent, or Firm*—Peter Abolins; Keith L. Zerschling

[57] ABSTRACT

A telescoped ammunition round has a propellant charge with an axial cavity. A projectile is housed within the cavity for being fired from the ammunition round. A wear additive is coupled to the forward portion of the propellant charge adjacent the axial cavity.

3 Claims, 3 Drawing Figures

TELESCOPED AMMUNITION CONSTRUCTION FOR REDUCING BARREL EROSION

BACKGROUND OF THE INVENTION

1. Field of the Invention

This invention relates to an apparatus for reducing barrel erosion in telescoped ammunition.

2. Prior Art

Cased telescoped ammunition is comprised of a propellant charge having an axial bore or cavity, a projectile housed entirely within the axial bore of the propellant charge and a primer positioned aft of the projectile. When a cased telescoped round of ammunition is loaded into the chamber of a gun, the projectile, being housed in a propellant charge, is not seated in the barrel of the gun as is the projectile of a round of conventional ammunition in a gun chamber. Upon initiation of the primer of the telescoped round, the projectile is forced forward into a barrel of the gun and becomes seated in the barrel.

High performance telescoped ammunition cartridges are available and capable of launching projectiles at very high speeds. The improved performance is attractive from an overall system effectiveness standpoint. However, the high performance is obtained by using high charge densities and high performance propellants. These factors expose the barrels of the telescoped ammunition weapon system to a thermal environment far above that experienced in current gun systems. The estimated increase in heat flux over conventional systems is about 25%. The high heat fluxes will tend to increase the rate of barrel wear and reduce the barrel life. It would be desirable to reduce the heating and wear rates in telescoped ammunition barrels. These are some of the problems this invention overcomes.

Reducing wear rates is taught with respect to standard cartridges having a different physical configuration than telescoped cartridges. For example, U.S. Pat. No. 3,209,689 to McLennan teaches a wear additive encircling the propellant charge. The ablative material is added to a conventional loose propellant charge round of ammunition. The additive is bonded to the cartridge case or loosely placed around the propellant charge. There is a cooling effect upon detonation as the heat from the burning propellant charge and from propellant gases decomposes a sleeve causing the formation of a boundary layer of cool inner gases which insulate the bore surface.

Other wear reducing disclosures relating to standard cartridges include the following. U.S. Pat. No. 4,098,193 issued to Schroeder describes a gas evolving sheath 3 disposed about the inner periphery of casings 7 and behind a projectile 9 as seen in FIG. 1 of the patent. U.S. Pat. No. 4,203,364 issued to Dobbs illustrates an ammunition cartridge having a liquid-filled capsule 34 which, upon firing, ruptures and the liquid flows around the projectile 26 to lubricate and cool the barrel. U.S. Pat. No. 4,334,477 issued to Axelrod et al uses a plastic film 16 which produces a cooling gas when the propellant ignites.

SUMMARY OF THE INVENTION

In accordance with an embodiment of this invention, a wear additive is molded into the inner lining of the front grain of the telescoped ammunition cartridge. Upon ignition, the projectile is boosted into the barrel by the control tube. As the projectile passes the wear additive, some of it is scraped off and pushed in front of the projectile to act as a wall lubricant, wear additive and heat barrier. The remainder of the wear additive will be carried off the liner walls by the booster plume and combustion gases subsequent to igniter port opening. The additive will be entrained in the gases and cause also to coat the barrel walls behind the projectile.

A result of this invention is to reliably and economically coat the barrel walls of a high performance telescoped cartridge with a wear additive such that barrel life can be extended. The additive will reduce the wall temperature and lubricate the barrel.

This invention includes a teaching of how to accommodate the additive in the round such that the additive is properly applied to the barrel wall during the ballistic cycle. Advantageously, the ablative is molded into the propellant charge. This strengthens the propellant charge, permits precise placement of the ablative and avoids the cost of a separate process wherein a wear additive is positioned around a cartridge. Thus, a telescoped cartridge in accordance with an embodiment of this invention is capable of achieving a higher level of erosion reduction than conventional rounds. Advantages of this invention include simplicity, reduced cost and reliability.

DETAILED DESCRIPTION OF THE INVENTION

Figures 1, 2, 3:
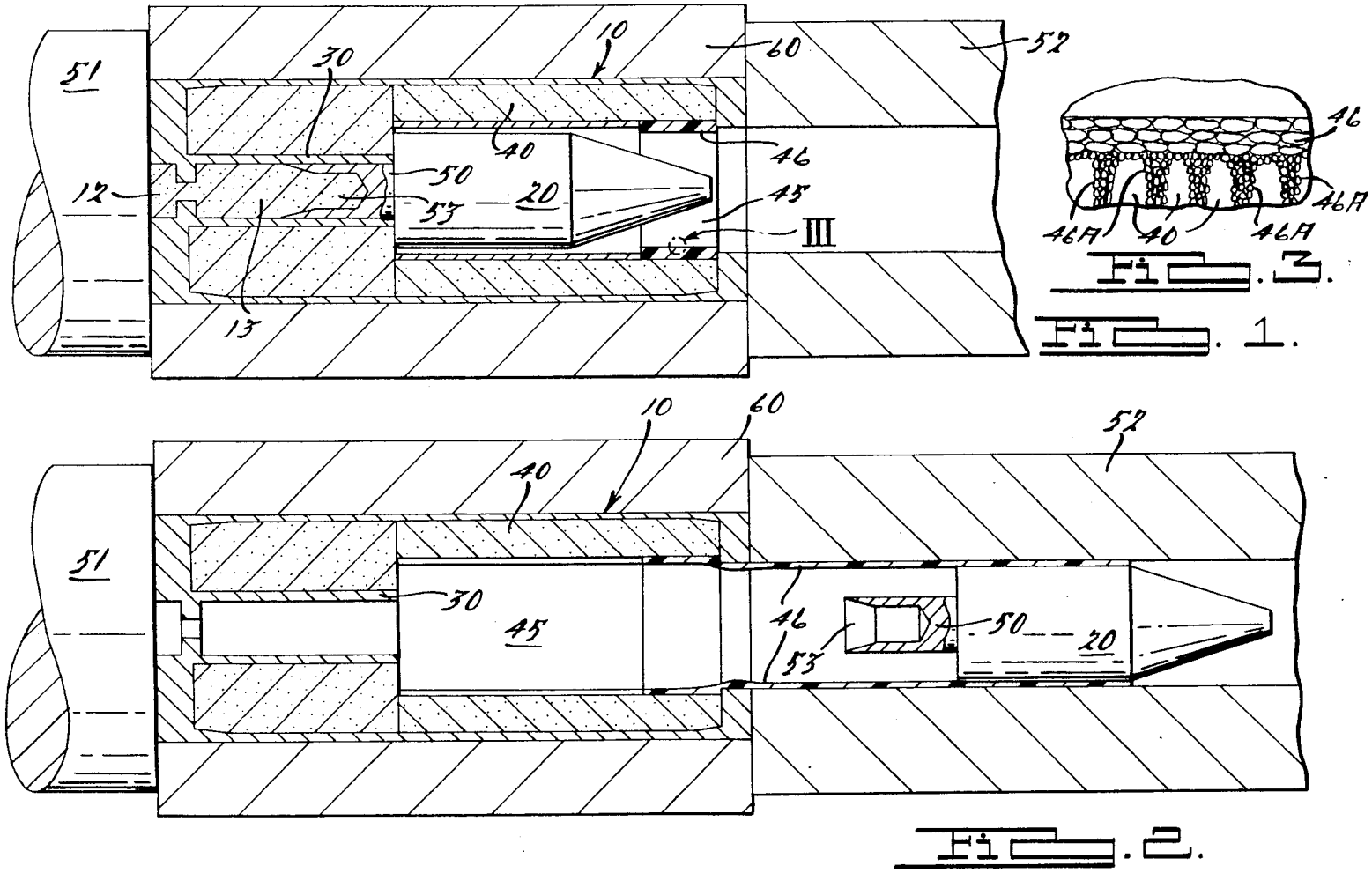
FIG. 1 is a longitudinal, partly section, view of an ammunition round in accordance with an embodiment of this invention.
FIG. 2 is a view of the ammunition round of FIG. 1 after the firing sequence has begun and the projectile has been moved forward and the wear additive starts to coat the barrel in accordance with an embodiment of this invention.
FIG. 3 is an enlarged portion of FIG. 1 including a schematic representation of pellets forming the ablator material with fingers extending into the propellant charge.

Referring to FIG. 1, an ammunition cartridge 10 is positioned within a chamber 60 which is forward of a breach 51 and aft of a barrel 52. Ammunition cartridge 10 includes a generally cylindrical main propellant charge 40 having a coaxial cavity 45, wherein is positioned a generally elongated tapered projectile 20. Positioned aft of projectile 20 is a generally cylindrical piston 50 having a longitudinal axis aligned with the longitudinal axis of axial cavity 45. A rear access 53 is a recess in the aft face of piston 50 and contains a booster charge 13 for propelling piston 50 forward within an axial cavity 45 which also causes corresponding forward motion of projectile 20 within axial cavity 45. A primer charge 12 is positioned aft of booster charge 13 and is fired to cause firing of booster charge 13. A control tube 30 is a generally cylindrical, hollow sheath which surrounds primer charge 12, booster charge 13 and piston 50. Control tube 30 is sized to fit snuggly within axial cavity 45 of main propellant charge 40 and has firing openings to pass a burning flame front from the region of booster charge 13 to main propellant charge 40. Firing of primer charge 12 and booster charge 13 causes piston 50 to move forward of the firing openings and expose main propellant charge 40 to ignition through the firing openings.

Ammunition cartridge 10 includes a molded in-place wear additive 46 circumferentially lining the forward portion of axial cavity 45. Wear additive 46 is molded into the liner of the front grain portion of main propellant charge 40 of the telescoped ammunition cartridge 10. Advantageously, it is a mechanical lubricator such as talcom, titanium dioxide ($TiO_2$), or a thermal ablator.

Upon ignition, projectile 20 is boosted into barrel 52 by piston 50. As projectile 20 passes wear additive 46, some of wear additive 46 is scraped off and pushed in front of projectile 20 to act as a wall lubricant, wear additive and heat barrier. The remainder of wear additive 46 will be carried off the liner walls by the booster plume and combustion gases subsequent to igniter port opening. Additive 46 will also be entrained in the gases and coat the walls of barrel 52 behind projectile 20. One position after the start of the firing sequence is shown in FIG. 2.

In accordance with this invention, the projectile is placed inside the propellant charge of a cartridge case and the ablative is molded into the consolidated propellant charge. Thus, the ablative is an integral part of the propellant charge. This strengthens the charge and can be done at a lower cost than adding it to the cartridge case. Being able to mold the ablative solidly into the propellant charge allows optimum placement of the erosion reduction material inside the cartridge case. This is not true of conventional ammunition where the additive can only be placed around the charge.

In one embodiment, the wear reduction or ablator materials are pressed or injection molded into hard pellets. These pellets are shaped to conform to the placement, particular configuration and geometric shape of the cartridge interior (see FIG. 3). The pellets are then placed at the desired position in the propellant mold and pressed into the propellant bed during the final consolidation process. Interlocking grooves or extensions 46A (see FIG. 3) confirmly hold the ablator or wear reduction material onto propellant charge 40.

Various modifications and variations will no doubt occur to those skilled in the various arts to which this invention pertains. For example, the particular configuration of the wear additive may be varied from that disclosed herein. These and all other variations which basically rely on the teachings through which this disclosure has advance the art are properly considered within the scope of this invention.

We claim:

1. A telescoped ammunition round comprising a propellant charge means having an axial cavity and supplying firing power for said ammunition round;

a projectile means housed within said cavity for being fired from said ammunition round; and a wear reducing additive means coupled to the forward portion of said propellant charge means adjacent said axial cavity, said wear reducing additive means being integrally molded to said propellant charge means adjacent the forward portion of said axial cavity thereby strengthening said propellant charge means and accurately positioning said wear reducing additive means, being in the form of hard pellets pressed into said propellant charge means, and having extensions protruding into said propellant charge means to improve coupling between said wear reducing additive and said propellant charge means.

2. A telescoped ammunition round as recited in claim 1 wherein said wear additive is talcom.

3. A telescoped ammunition round as recited in claim 1 wherein said wear additive is titanium dioxide ($TiO_2$).

* * * * *